US007162170B2

(12) United States Patent
Kayahara

(10) Patent No.: US 7,162,170 B2
(45) Date of Patent: Jan. 9, 2007

(54) METHOD AND APPARATUS FOR IMAGE FORMING CAPABLE OF EFFECTIVELY PREVENTING TONER ADHESION ON A DENSITY SENSOR BY GENERATING AN ELECTRIC FIELD ACCORDING TO A VISIBLE IMAGE

(75) Inventor: Shin Kayahara, Urayasu (JP)

(73) Assignee: Ricoh Company, Ltd., Tokyo (JP)

( * ) Notice: Subject to any disclaimer, the term of this patent is extended or adjusted under 35 U.S.C. 154(b) by 204 days.

(21) Appl. No.: 10/920,405

(22) Filed: Aug. 18, 2004

(65) Prior Publication Data

US 2005/0105927 A1 May 19, 2005

(30) Foreign Application Priority Data

Aug. 18, 2003 (JP) ..... 2003-294241

(51) Int. Cl.
*G03G 15/00* (2006.01)

(52) U.S. Cl. ..... 399/49; 399/98

(58) Field of Classification Search ..... 399/302, 399/30, 8, 66, 64, 99, 107, 100, 54, 49, 101, 399/74, 308, 3

See application file for complete search history.

(56) References Cited

U.S. PATENT DOCUMENTS 5,461,461 A * 10/1995 Harasawa et al. ..... 399/66
6,061,543 A 5/2000 Kayahara et al.
6,212,351 B1 4/2001 Kawagoe et al.
6,269,228 B1 7/2001 Kayahara et al.
6,505,024 B1 1/2003 Kayahara et al.
6,564,021 B1 * 5/2003 Nakai et al. ..... 399/49
6,654,574 B1 11/2003 Kayahara et al.
6,697,595 B1 2/2004 Kawagoe et al.
6,701,118 B1 3/2004 Kayahara et al.
6,778,794 B1 8/2004 Kayahara
2003/0118359 A1 * 6/2003 Ogiyama et al. ..... 399/45

FOREIGN PATENT DOCUMENTS

JP 2001-142279 5/2001
JP 2001-318539 11/2001

OTHER PUBLICATIONS

U.S. Appl. No. 10/920,405, filed Aug. 18, 2004 Kayahara.
U.S. Appl. No. 11/289,267, filed Nov. 30, 2005 Hashimoto et al.
U.S. Appl. No. 10/389,979, filed Mar. 18, 2003 Ogiyama et al.
U.S. Appl. No. 40/464,537, filed Jun. 19, 2003 Kayahara.
U.S. Appl. No. 10/700,486, filed Nov. 5, 2003 Yoshida et al.

* cited by examiner

*Primary Examiner*—David M. Gray
*Assistant Examiner*—David A Blackshire
(74) *Attorney, Agent, or Firm*—Oblon, Spivak, McClelland, Maier & Neustadt, P.C.

(57) ABSTRACT

An image forming apparatus includes an image bearing member configured to bear a visible image including a toner charged with a predetermined polarity, an intermediate transfer member configured to receive the visible image from the image bearing member during a primary transfer process before the visible image is transferred onto a transfer medium during a secondary transfer process, a sensor configured to detect a density of the visible image, and a supporting member configured to support the intermediate transfer member and to generate an electric field having a polarity opposite to the predetermined polarity of the toner, in which the supporting member is held in contact with the intermediate transfer member and facing the sensor with the intermediate transfer member interposed therebetween.

15 Claims, 4 Drawing Sheets

METHOD AND APPARATUS FOR IMAGE FORMING CAPABLE OF EFFECTIVELY PREVENTING TONER ADHESION ON A DENSITY SENSOR BY GENERATING AN ELECTRIC FIELD ACCORDING TO A VISIBLE IMAGE

CROSS REFERENCE TO RELATED APPLICATIONS

The present application claims priority under 35 U.S.C. § 119 to Japanese Patent Application No. 2003-294241 filed on Aug. 18, 2003 in the Japanese Patent Office, the entire contents of which are incorporated herein by reference.

BACKGROUND OF THE INVENTION

1. Field of the Invention

The present invention relates an image forming apparatus and particularly to a structure for preventing particle accumulation on an image-density sensor due to, for example, toner adhesion.

2. Discussion of the Background

In an image forming apparatus, such as a copier, a printer, a facsimile machine, and a printing machine, a visible image formed on a photoconductor serving as an image bearing member for an electrostatic latent image is transferred to a recording medium, such as a sheet of paper, thereby creating a final copy.

Images on the final copy are printed in monochrome color or in multiple colors, such as in full color. To obtain a monochrome image, an image processing unit includes an image bearing member for a single electrostatic latent image and its corresponding electrifying device, writing device, developing device, and transfer device. To obtain a multicolor image, for example, tandem type image processing units capable of forming images in respective colors are used.

In an image forming apparatus including tandem type image processing units for obtaining a full color image, a belt movable while being kept in contact with photoconductors in the respective image processing units functions as an intermediate transfer member. In a primary transfer process, images formed in the respective image processing units are sequentially transferred to the intermediate transfer member to superimpose the images thereon. The superimposed images are then simultaneously transferred to a recording medium in a secondary transfer process.

In an image forming apparatus, the image density may change depending on changes in the operating environment and the number of copies performed. Since changes in colors are particularly noticeable in color images, attempts to maintain uniform density have been made. For example, patch images in respective colors are formed on an intermediate transfer member to detect the density of each patch image by an optical density sensor. Then, image forming conditions, such as electrifying conditions and developing conditions, are adjusted depending on the result of the detection.

If the optical density sensor as described above is used as a density sensor, particles remaining on a detection window due to, for example, toner adhesion may interfere with accurate detection. Paper dust generated due to, for example, a paper jam may contaminate the detection window to interfere with accurate detection.

Possible approaches to prevent particles from remaining on the detection window include applying airflow from a cooling fan installed in an image forming apparatus to the surface of the detection window, installing or preparing a user-operable cleaning tool, and carrying out periodic cleaning by service engineers.

The above-described approaches are effective if the image forming apparatus has space for installing a cleaning unit. However, it is difficult to take such approaches in a space-saving type apparatus, which is required these days.

For example, an image forming apparatus may not have enough space for installation of a duct that introduces airflow, or, even if the duct is installed, the duct may not be capable of securing the airflow required for removing particles. In addition, space for inserting someone's hands for a cleaning operation cannot be secured. Moreover, the cleaning operation itself is a cumbersome task and may not be carried out very frequently. This causes toner accumulation and interferes with complete removal of particles. Furthermore, installation of a cleaning tool not only causes an increase in cost but also causes loss of time for the image forming operation during the cleaning operation performed by service engineers. If a user is involved in the cleaning operation, in this case, such a cumbersome task may not be carried out frequently and may cause problems as described above.

SUMMARY OF THE INVENTION

The present invention has been made in view of the above-described circumstances.

An object of the present invention is to provide an image forming apparatus capable of effectively preventing toner adhesion on a density sensor by generating an electric field according to a visible image.

An object of the present invention is to provide a method used in the above-described novel image forming apparatus.

A novel image forming apparatus includes an image bearing member, an intermediate transfer member, a sensor and a supporting member. The image bearing member is configured to bear a visible image including a toner charged with a predetermined polarity. The intermediate transfer member is configured to receive the visible image from the image bearing member during a primary transfer process before the visible image is transferred onto a transfer medium during a secondary transfer process. The sensor is configured to detect a density of the visible image. The supporting member is configured to support the intermediate transfer member and to generate an electric field having a polarity opposite to the predetermined polarity of the toner. The supporting member is held in contact with the intermediate transfer member and faces the sensor via the intermediate transfer member interposed therebetween.

The supporting member may generate the electric field having the polarity opposite to the predetermined polarity of the toner included in the visible image when the visible image on the intermediate transfer member passes by the sensor.

The supporting member may include a transfer electric field generator used during the secondary transfer process. The transfer electric field generator may be held in contact with an inner surface of the intermediate transfer member.

The transfer electric field generator may generate, during the secondary transfer process, an electric field having a polarity the same as the predetermined polarity of the toner included in the visible image.

The visible image may be formed for density detection and for image transfer, and the supporting member for the intermediate transfer member may vary an intensity of the electric field depending on whether the visible image passing by is for density detection or for image transfer.

A novel method of image forming includes the steps of forming a visible image on an image bearing member, in which the visible image including a toner charged with a predetermined polarity, transferring the visible image from the image bearing member onto an intermediate transfer member during a primary transfer process, transferring the visible image from the intermediate transfer member onto a transfer medium during a secondary transfer process, detecting a density of the visible image using a sensor, and generating an electric field having a polarity opposite to the predetermined polarity of the toner by a supporting member being held in contact with the intermediate transfer member and facing the sensor via the intermediate transfer member interposed therebetween.

The supporting member may generate the electric field having the polarity opposite to the predetermined polarity of the toner included in the visible image during the detecting step.

The supporting member may include a transfer electric field generator contacting with an inner surface of the intermediate transfer member.

The generating step may generate an electric field having a polarity same as the predetermined polarity of the toner included in the visible image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
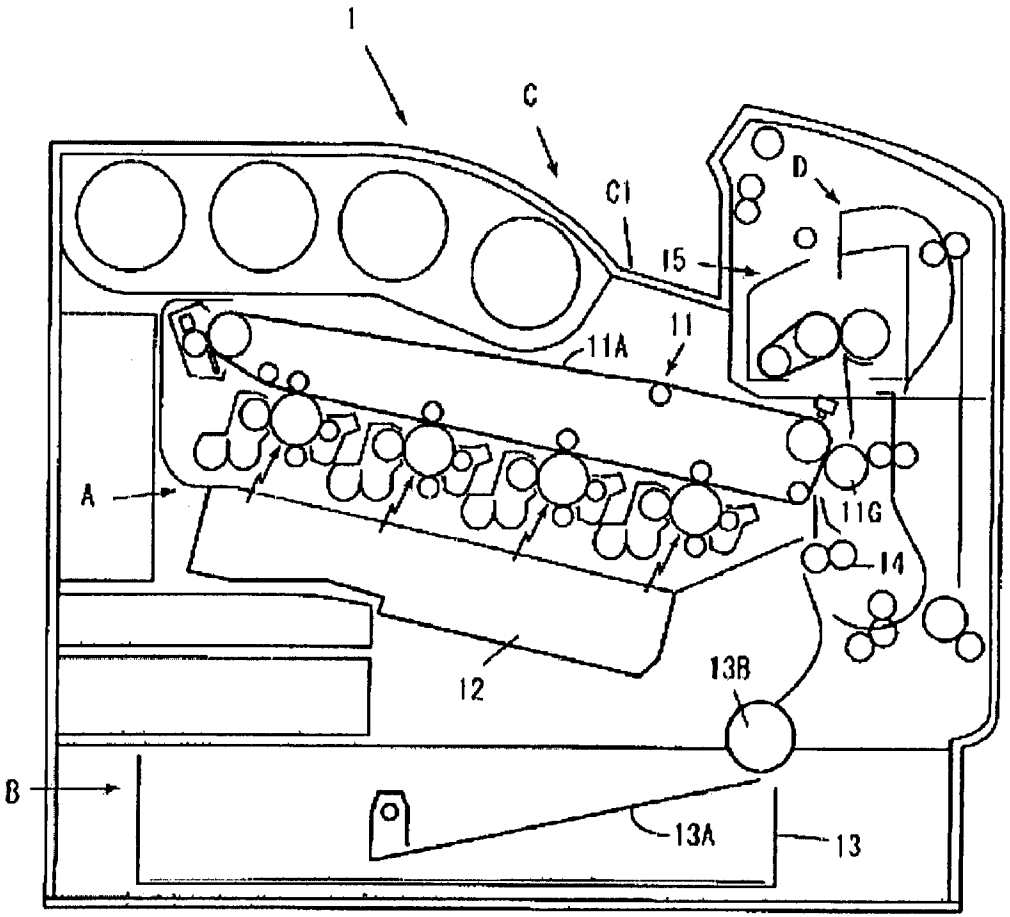
FIG. 1 is a diagram showing the structure of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 is a diagram showing the structure of an image forming apparatus according to an embodiment of the present invention. The image forming apparatus in FIG. 1 is a printer in which writing processes are carried out in accordance with image information; however, the present invention is not limited to this and may include copiers, facsimile machines, and printing machines as examples of the image forming apparatus.

An image forming apparatus 1 includes an image processor A disposed at the center in the vertical direction, a paper feeder B disposed below the image processor A, and a paper ejector C disposed above the image processor A.

The image processor A includes a plurality of image processing units 10Y, 10C, 10M, and 10Bk, an intermediate transfer unit 11, and an optical writing unit 12. The image processing units 10Y, 10C, 10M, and 10Bk are arranged adjacent to each other and, preferably, in contact with one another to form images in respective colors. The intermediate transfer unit 11 includes an endless belt (intermediate transfer member) 11A extending parallel to the line along which the image processing units 10Y, 10C, 10M, and 10Bk are arranged. The optical writing unit 12 applies light beams to photoconductors, which are image bearing members included in the respective image processing units 10Y, 10C, 10M, and 10Bk, for forming electrostatic latent images.

Figure 2:
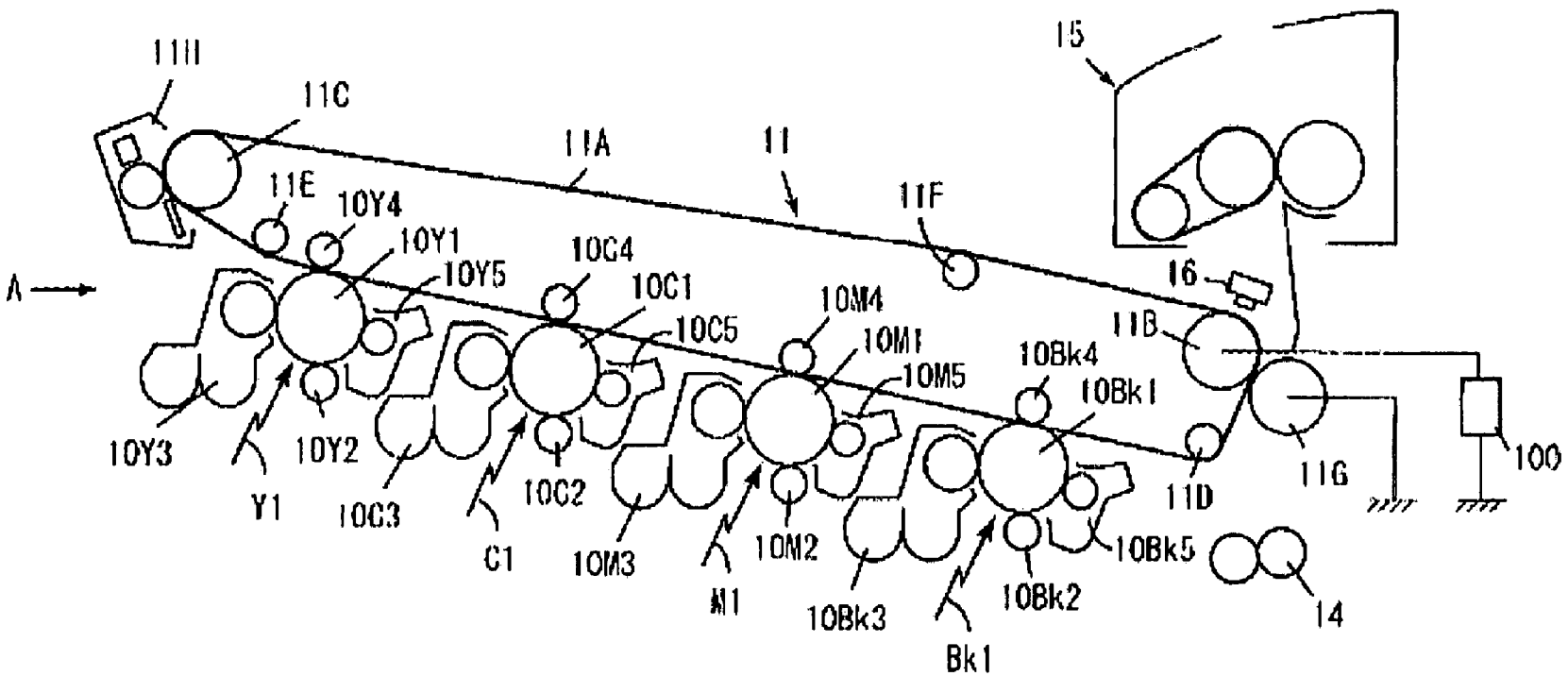
FIG. 2 is a diagram showing the structure of a main part of the image forming apparatus of FIG. 1.

FIG. 2 illustrates the image processor A in detail. Referring to FIG. 2, the image processing units 10Y, 10C, 10M, and 10Bk include drum-shaped photoconductors 10Y1, 10C1, 10M1, and 10Bk1, respectively, that serve as image bearing members. The photoconductors 10Y1, 10C1, 10M1, and 10Bk1 are surrounded by electrifying devices 10Y2, 10C2, 10M2, and 10Bk2, respectively, developing devices 10Y3, 10C3, 10M3, and 10Bk3, respectively, transfer devices 10Y4, 10C4, 10M4, and 10Bk4, respectively, for primary transfer processes, and cleaning devices 10Y5, 10C5, 10M5, and 10Bk5, respectively. Each charging device, developing device, transfer device, and cleaning device that is provided for carrying out image forming processes is arranged along the rotation direction (clockwise in the structure shown in FIG. 2) of each photoconductor. The optical writing unit 12 shown in FIG. 1 applies light beams Y1, C1, M1, and Bk1 shown in FIG. 2 to the respective photoconductors 10Y1, 10C1, 10M1, and 10Bk1.

The intermediate transfer unit 11 includes the endless belt 11A that runs over a supporting roller (supporting member) 11B and a supporting roller 11C. The endless belt 11A made of rubber or resin has a single layer structure or a multilayer structure and has chargeable surface or surfaces.

The endless belt 11A runs over a roller 11D and a roller 11E, which are arranged on one side adjacent to the image processing units 10Y, 10C, 10M, and 10Bk, so as to be in contact with the photoconductors 10Y1, 10C1, 10M1, and 10Bk1. The endless belt 11A also runs over a roller 11F that is arranged on the other side remote from the image processing units 10Y, 10C, 10M, and 10Bk, thereby moving counterclockwise in FIG. 2.

In the intermediate transfer unit 11, visible images formed in the photoconductors 10Y1, 10C1, 10M1, and 10Bk1 are sequentially transferred to the endless belt 11A, through a primary transfer process performed by the transfer devices 10Y4, 10C4, 10M4, and 10Bk4 that are opposite the respective photoconductors 10Y1, 10C1, 10M1, and 10Bk1 with the endless belt 11A interposed therebetween. The visible images transferred to the endless belt 11A are then superimposed, and the superimposed images are simultaneously transferred to a transfer medium at a secondary transfer point.

The secondary transfer point is determined by the supporting roller 11B and a secondary transfer roller 11G that are opposite each other and nip the endless belt 11A therebetween. The supporting roller 11B is connected to a transfer bias supply 100 and serves as means for generating transfer electric fields. The transfer bias supply 100 feeds a predetermined voltage to the supporting roller 11B to generate an electric field during a secondary transfer process. The secondary transfer roller 11G is made of elastic material, for example, polyurethane resin, so that the secondary transfer roller 11G can nip and convey a transfer medium, in cooperation with the supporting roller 11B, while pressing the transfer medium against the endless belt 11A. The secondary transfer roller 11G is arranged on the ground side in a transfer electric field generated by the supporting roller 11B.

The endless belt 11A moves counterclockwise in FIG. 2. When a batch transfer of superimposed images to a transfer medium is completed at the secondary transfer point, a belt cleaner 11H removes residual toner from the endless belt 11A.

Referring to FIG. 1, the paper feeder B includes a paper cassette 13 holding recording media, that is, transfer media, such as sheets of transfer paper. The single sheets of transfer media placed on a loading plate 13A in the paper cassette 13 are supplied through a supply roller 13B and a separated mechanism (not shown).

The transfer media from the paper cassette 13 pass through registration rollers 14, which sets a resist timing for the transfer media prior to facing the intermediate transfer unit 11, and are supplied toward the secondary transfer point in the intermediate transfer unit 11.

The transfer media that have passed through the secondary transfer point in the intermediate transfer unit 11 are sent to a fixing unit 15, which fixes toner images on the transfer media with heat and pressure, and are ejected to a paper tray C1 included in the paper ejector C shown in FIG. 1. For forming images on both sides, the transfer media that have passed through the fixing unit 15 are sent to a refeeder D, flipped over, and refed to the registration rollers 14.

In the image forming apparatus 1 structured as described above, visible images, that is, toner images formed in the photoconductors 10Y1, 10C1, 10M1, and 10Bk1 of the respective image processing units 10Y, 10C, 10M, and 10Bk are transferred, through the primary transfer process, to the endless belt 11A, which carries the toner images thereon, of the intermediate transfer unit 11. Then, monochrome or superimposed images are simultaneously transferred, through the secondary transfer process, to a transfer medium that is supplied from the paper feeder B via the registration rollers 14 to the secondary transfer point.

At the secondary transfer point, power from the transfer bias supply 100 allows the supporting roller 11B, which serves as a means for generating electric fields for the secondary transfer, to generate an electric field having the same polarity as that of the toner images. Then, the electric field allows toner on the endless belt 11A to be electrostatically transferred to the transfer medium. The transfer medium that has passed through the secondary transfer point is fused by the fixing unit 15 and sent to the paper ejector C or to the refeeder D.

In the image processing units 10Y, 10C, 10M, and 10Bk, the respective photoconductors 10Y1, 10C1, 10M1, and 10Bk1 that have completed a primary transfer go through a cleaning process by the respective cleaning devices 10Y5, 10C5, 10M5 and 10Bk5, and an electrifying process by the respective electrifying devices 10Y2, 10C2, 10M2, and 10Bk2, and then prepare for the next image forming process. In the intermediate transfer unit 11, residual toner on the surface of the endless belt 11A that has passed through the secondary transfer point is removed by the belt cleaner 11H, thereby allowing the endless belt 11A to prepare for the next transfer process.

To maintain uniform image density, the image forming apparatus 1 of the present embodiment includes a density sensor 16, which is a reflective optical sensor disposed in the vicinity of the secondary transfer point and which serves as a sensor for detecting the density of toner images transferred to the endless belt 11A of the intermediate transfer unit 11.

The density sensor 16 detects the density of the toner images on the endless belt 11A after the secondary transfer process, and outputs the result to an image forming controller (not shown). The image forming controller compares the density of the toner images after the secondary transfer process with a predetermined density. Then, if necessary, the image forming controller adjusts the image forming conditions, such as electrification conditions, amount of toner, and developing conditions, including developing biases, to maintain uniform density of the toner images.

To determine the toner density, in the present embodiment, a test patch image for density detection is formed in addition to an image to be transferred to a transfer media in the photoconductors 10Y1, 10C1, 10M1, and 10Bk1 of the respective image processing units 10Y, 10C, 10M, and 10Bk. Examples of timing for forming the test patch image include the time when the image forming apparatus 1 starts operating, the time when the formation of a predetermined number of images is completed, the time after a predetermined time period, and other predetermined timing. The test patch image measures 25 mm by 20 mm.

Similarly to the image to be transferred to a transfer medium, the test patch image passes through the secondary transfer point. However, unlike in the case of the image to be transferred to a transfer medium, the polarity of the electric field generated here is opposite that of the toner included in the test patch image. Therefore, since the test patch image, that is, toner in the test patch image, is electrostatically adsorbed onto the endless belt 11A, the toner is prevented from scattering toward the density sensor 16 disposed in the vicinity of the secondary transfer point. Thus, in density detection using the test patch image, particles on the density sensor 16 due to toner scattering from the endless belt 11A can be prevented.

Figure 3:
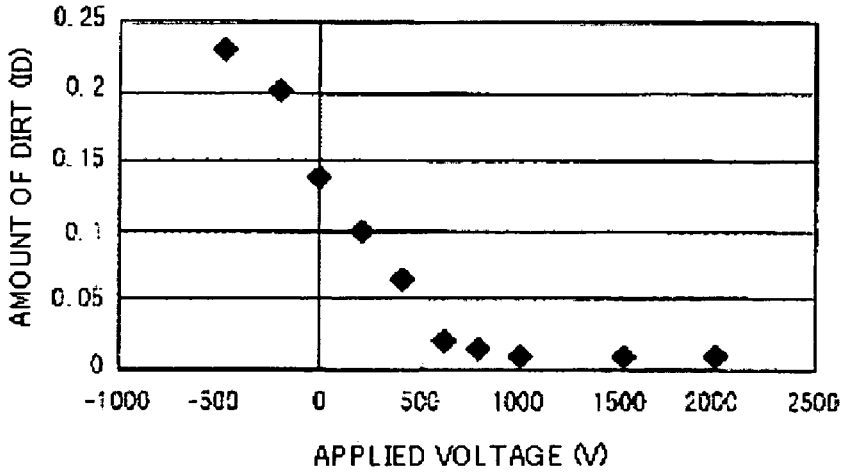
FIG. 3 is a diagram showing the result of an experiment to determine the relationship between electric field generating conditions and the amount of particles on a density sensor in the image forming apparatus according to the embodiment of the present invention.

FIG. 3 is the result of an experiment conducted by the present inventor, and shows the relationship between particles on the density sensor 16 and the voltage applied to the supporting roller 11B as an electric field generator for generating an electric field in density sensing using a test patch image. As shown, the application of a voltage in a range from approximately +500 V to approximately +3000V, the voltage having a polarity opposite that of the toner, to the supporting roller 11B serving as means for generating electric fields reduces the amount of toner scattering from the test patch image, thereby substantially preventing particle accumulation on the density sensor 16.

The experiment whose result is shown in FIG. 3 was conducted under the following conditions.

After a test patch image passed through the secondary transfer point 100 times, particles on the density sensor 16 were collected on adhesive tape and quantified by an image density measurement. The image density was detected by a spectrodensitometer (Type 938) manufactured by X-Rite, Incorporated.

The supporting roller 11B serving as means for generating electric fields varies the direction and the intensity of the electric fields depending on whether the density is detected using the test patch image, or an image to be transferred to a transfer medium, other than the test patch image, is transferred in the secondary transfer process. The conditions are as follows:

(1) In the secondary transfer of an image to be transferred to a transfer medium, a current or a voltage having the same polarity as that of the toner is applied to the supporting roller 11B for the secondary transfer output.

(2) When an image (a test patch image, an unnecessary toner image adhering to the endless belt 11A) other than the image described in the condition (1) passes through the secondary transfer point, a voltage having a polarity opposite that of the toner is applied to the supporting roller 11B.

(3) In cases other than the conditions (1) and (2), a voltage having the same polarity as that of toner or a voltage of 0 V is applied to the supporting roller 11B.

In addition, the intensity of the electric field in the condition (2) is in the range of approximately +500V to approximately +3000V. That is, to prevent a problem in transfer, the intensity of the electric field in the secondary transfer needs to be high enough so that electrostatic transfer of toner to a transfer medium can be efficiently performed. On the other hand, when a test patch image passes through the secondary transfer point, the electric field intensity that can prevent scattering of toner, without causing an increase in the load on the belt cleaner 11H in cleaning, is high enough.

Figure 4:
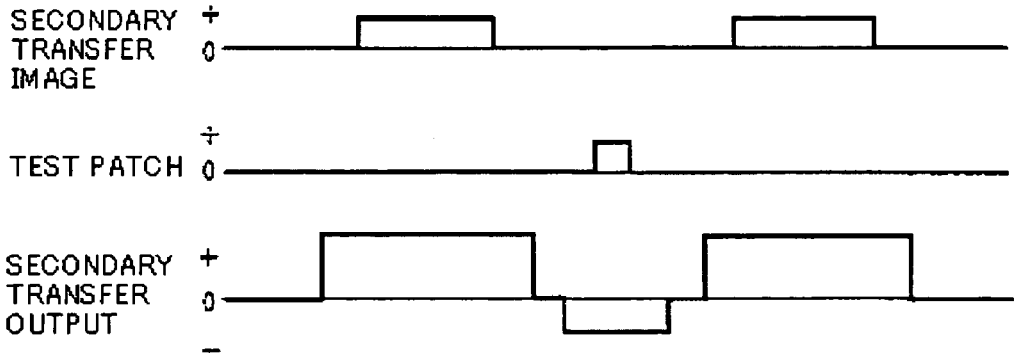
FIG. 4 is a timing chart for explaining states of the electric field generation based on the electric field generating conditions shown in FIG. 3.

The unnecessary toner image described in the condition (2) refers to a large amount of untransferred toner adhering to the endless belt 11A due to, for example, a jam of the transfer medium. In this case, an increase in the amount of toner facing the density sensor 16 before reaching the belt cleaner 11H causes an increase in the amount of toner scattering. To prevent such scattering of toner, conditions for electric field generation are set, in the present embodiment, for allowing toner to adhere to the endless belt 11A. FIG. 4 shows the timing of electric field generation based on these conditions. Referring to FIG. 4, the direction of electric field generation when an image to be transferred to a transfer medium passes through the secondary transfer point is opposite the direction of electric field generation when a test patch image passes through the secondary transfer point. The electric field intensity in the two cases may also be different.

Since the image forming apparatus 1 of the present embodiment is structured as described above, conditions for electric field generation in the supporting roller 11B, which serves as means for generating electric fields, can be changed depending on whether the image passing through the secondary transfer point is a test patch image or an image to be transferred to a transfer medium.

Therefore, when an image to be transferred to a transfer medium passes through the secondary transfer point, generation of an electric field having the same polarity as that of the toner accelerates electrostatic transfer of toner to a transfer media, and thus transfer efficiency is improved. On the other hand, when a test patch image passes through the secondary transfer point, generation of an electric field having a polarity opposite that of the toner prevents the toner from scattering from the endless belt 11A. As a result, particles on the density sensor 16 in detecting density and deterioration in detection accuracy can be prevented, and thus uniform image density can be maintained.

Each component included in the image forming apparatus 1 of the present embodiment will now be described.

The photoconductors, which are organic photoconductors (OPCs), equally electrified at a voltage of −200 V to −2000 V by the electrifying devices are radiated with laser light corresponding to images on a document so as to perform optical writing, thereby forming electrostatic latent images. Negatively charged toner is attracted to positively charged areas on the photoconductors, thereby forming visible images. The endless belt 11A of the intermediate transfer unit 11 is made of thermosetting resin and measures 0.10 mm thick by 246 mm wide by 796 mm long inner circumference. The speed of the endless belt 11A is set at 150 mm/second.

The volume resistivity of the entire endless belt 11A made of such material is $10^7$ to $10^{12}$ Ωcm by measurement. This volume resistivity is obtained by applying a voltage of 100 V for 10 seconds, according to the measurement method specified in Japanese Industrial Standard (JIS) K 6911. The surface resistivity of the endless belt 11A is $10^9$ to $10^{14}$ Ω/square according to a measurement using a resistivity meter "Hiresta IP" manufactured by Mitsubishi Yuka Corporation Limited. The surface resistivity can also be measured according to the surface resistivity measurement method specified in JIS K 6911.

The secondary transfer roller 11G is made of polyurethane foam resin and is 26 mm in diameter and 230 mm in width. The density sensor 16 is a reflective sensor and is about 4 mm away from the endless belt 11A. The density sensor 16 initially measures the density on an area of the endless belt 11A where no image is formed and measures, for comparison, the density on an area where images are formed, thereby determining the density.

According to the embodiment described above, the supporting roller 11B of the endless belt 11A serves as means for generating transfer electric fields and is capable of varying the electric fields. As previously described, the supporting roller 11B is arranged inside a loop of the endless belt 11A, and is held in contact with an inner surface of the endless belt 11A. The supporting roller 11B also faces the secondary transfer roller 11G to nip the endless belt 11A therebetween. The supporting roller 11B is connected to the transfer bias supply 100 which feeds the predetermined voltage to the supporting roller 11B to generate an electric field during the secondary transfer process. Thus, particle accumulation on the density sensor 16 can be prevented by a known simple structure.

Figure 5:
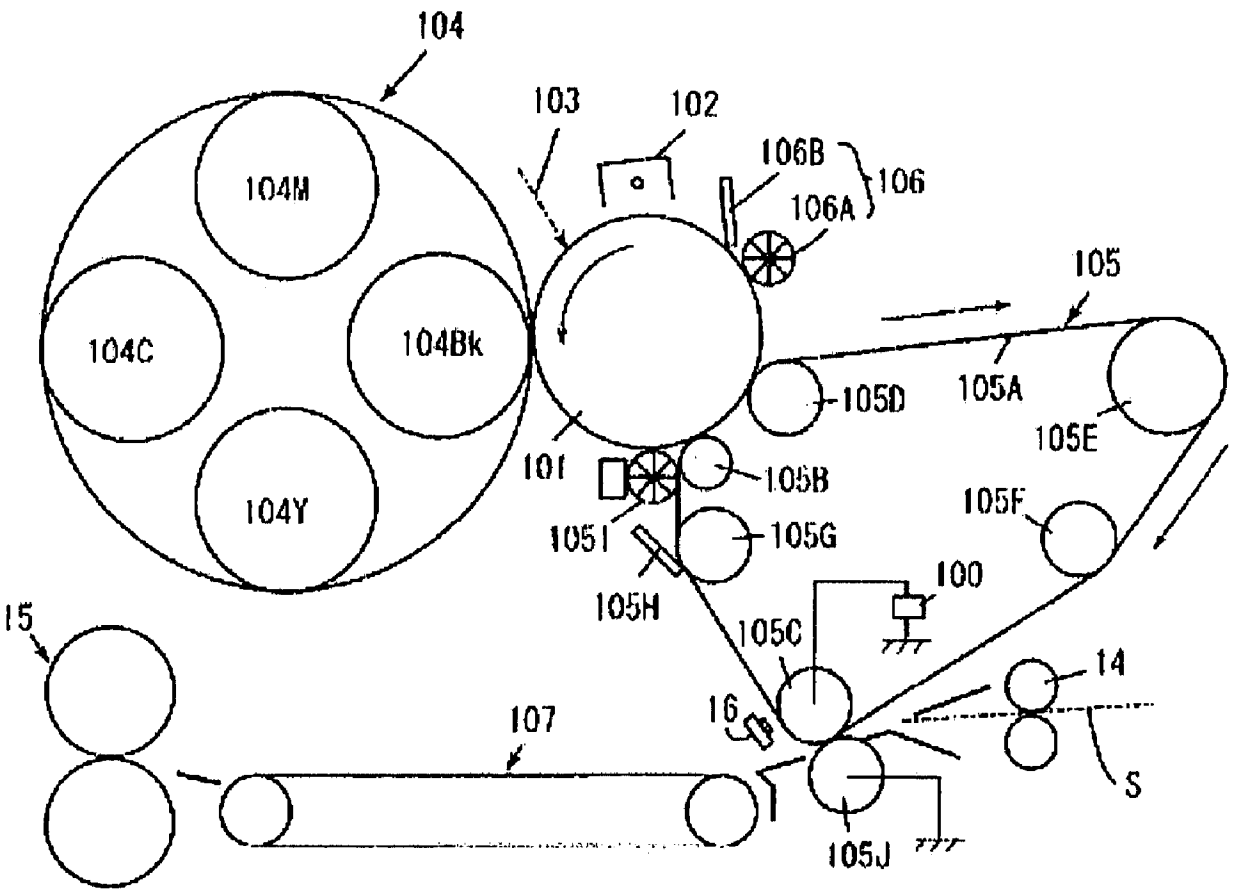
FIG. 5 is a diagram showing a modification of the structure of the image forming apparatus in FIG. 1.

While the image forming apparatus including the tandem type image processing units 10Y, 10C, 10M, and 10Bk has been described in the above-described embodiment, other types of the image forming apparatus may be used according to the present invention. As shown in FIG. 5, the image forming apparatus of the present invention may have a structure in which image processing units are grouped together in one drum. In FIG. 5, the same components as those shown in FIGS. 1 and 2 are indicated by the same reference numerals.

Referring to FIG. 5, a selected unit or all image processing units 104Y, 104C, 104M, and 104Bk included in a developing device 104 sequentially operate to form a visible image in monochrome or in multiple colors, based on an electrostatic latent image formed in a photoconductor 101. That is, the photoconductor 101 is disposed surrounded by an electrifying device 102, a writing device (only a light beam is shown in FIG. 5) 103, a developing device 104, a transfer device 105, and a cleaning device 106. Here, a visible image formed in the photoconductor 101 is transferred to an endless belt 105A of the transfer device 105 in a primary transfer process.

The transfer device 105 includes the endless belt 105A running over a plurality of rollers 105B, 105C, 105D, 105E, 105F and 105G. The roller 105B serves as a transfer roller for the primary transfer process. The roller 105C, which is connected to the transfer bias supply 100, serves as means for generating electric fields for transfer, similarly to the supporting roller 11B in FIG. 2.

Moreover, a cleaning brush 106A and a cleaning blade 106B are included in the cleaning device 106, while a cleaning brush 105I and a cleaning blade 105H serve as belt cleaners. A roller 105J functions similarly to the secondary transfer roller 11G in FIG. 2. A conveyer belt 107 conveys a transfer medium to a fixing unit 15 after a secondary transfer process.

In this structure, similarly to the structure shown in FIGS. 1 and 2, the roller 105C located at a secondary transfer point generates different electric fields depending on whether a test patch image is transferred or other images to be transferred to a transfer medium are transferred, thereby preventing toner from scattering toward a density sensor 16 to avoid particle accumulation on the density sensor 16.

In addition, as modifications to the structure in FIGS. 1 and 2, the photoconductors, the transfer devices for the intermediate transfer unit, and the secondary transfer roller may have belt forms or drum forms. Furthermore, the supporting roller 11B may be replaced with a brush or a Mylar member that can be in contact with the endless belt 11A.

Numerous additional modifications and variations are possible in light of the above teachings. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

an image bearing member configured to bear a visible image including a toner charged with a predetermined polarity;

an intermediate transfer member configured to receive the visible image from the image bearing member during a primary transfer process before the visible image is transferred onto a transfer medium during a secondary transfer process;

a sensor configured to detect a density of the visible image; and a supporting member configured to support the intermediate transfer member and to generate an electric field having a polarity opposite to the predetermined polarity of the toner, the supporting member being held in contact with the intermediate transfer member and facing the sensor with the intermediate transfer member interposed therebetween, wherein the supporting member generates the electric field having the polarity opposite to the predetermined polarity of the toner included in the visible image when the visible image on the intermediate transfer member is passing by the sensor.

2. The image forming apparatus according to claim 1, wherein the supporting member is connected to a transfer electric field generator used during the secondary transfer process, the supporting member being held in contact with an inner surface of the intermediate transfer member.

3. The image forming apparatus according to claim 1, wherein the supporting member generates, during the secondary transfer process, an electric field having a polarity same as the predetermined polarity of the toner included in the visible image.

4. The image forming apparatus according to claim 1, wherein the visible image is formed for density detection and for image transfer, and the supporting member for the intermediate transfer member varies an intensity of the electric field depending on whether the visible image passing by is for density detection or for image transfer.

5. The image forming apparatus according to claim 1, wherein the supporting member generates the electric field having the polarity opposite to the predetermined polarity of the toner included in the visible image when the visible image on the intermediate transfer member is opposite the sensor.

6. An image forming apparatus, comprising:

bearing means for bearing a visible image including a toner charged with a predetermined polarity;

receiving means for receiving the visible image from the bearing means during a primary transfer process before the visible image is transferred onto a transfer medium during a secondary transfer process;

detecting means for detecting a density of the visible image; and supporting means for supporting the receiving means and generating an electric field having a polarity opposite to the predetermined polarity of the toner, the supporting means being held in contact with the receiving means and facing the detecting means with the receiving means interposed therebetween, wherein the supporting means generates the electric field having the polarity opposite to the predetermined polarity of the toner included in the visible image when the visible image on the receiving means is passing by the detecting means.

7. The image forming apparatus according to claim 6, wherein the supporting means includes generating means used during the secondary transfer process, the supporting means being held in contact with an inner surface of the receiving means.

8. The image forming apparatus according to claim 6, wherein the s supporting means generates, during the secondary transfer process, an electric field having a polarity same as the predetermined polarity of the toner included in the visible image.

9. The image forming apparatus according to claim 6, wherein the visible image is formed for density detection and for image transfer, and the supporting means for the receiving means varies an intensity of the electric field depending on whether the visible image passing by is for density detection or for image transfer.

10. The image forming apparatus according to claim 6, wherein the supporting means generates the electric field having the polarity opposite to the predetermined polarity of the toner included in the visible image when the visible image on the intermediate transfer member is opposite the sensor.

11. A method of image forming, comprising the steps of:

forming a visible image on an image bearing member, the visible image including a toner charged with a predetermined polarity;

transferring the visible image from the image bearing member onto an intermediate transfer member during a primary transfer process;

transferring the visible image from the intermediate transfer member onto a transfer medium during a secondary transfer process;

detecting a density of the visible image using a sensor; and generating an electric field having a polarity opposite to the predetermined polarity of the toner by a supporting member being held in contact with the intermediate transfer member and facing the sensor with the intermediate transfer member interposed therebetween, wherein the supporting member generates the electric field having the polarity opposite to the predetermined polarity of the toner included in the visible image during the detecting step.

12. The method according to claim 11, wherein the supporting member includes a transfer electric field generator, the supporting member contacting with an inner surface of the intermediate transfer member.

13. The method according to claim 11, wherein the generating step also generates an electric field having a polarity same as the predetermined polarity of the toner included in the visible image.

14. The method according to claim 11, wherein the visible image is formed for density detection and for image transfer, and the supporting member for the intermediate transfer member varies an intensity of the electric field depending on whether the visible image passing by is for density detection or for image transfer.

15. The method according to claim 11, wherein the supporting member generates the electric field having the polarity opposite to the predetermined polarity of the toner included in the visible image when the visible image on the intermediate transfer member is opposite the sensor.

* * * * *